US010019997B2

(12) United States Patent
Jax

(10) Patent No.: US 10,019,997 B2
(45) Date of Patent: Jul. 10, 2018

(54) METHOD AND APPARATUS FOR QUANTISATION INDEX MODULATION FOR WATERMARKING AN INPUT SIGNAL

(75) Inventor: Peter Jax, Hannover (DE)

(73) Assignee: Thomson Licensing, Issy-les-Moulineaux (FR)

( * ) Notice: Subject to any disclaimer, the term of this patent is extended or adjusted under 35 U.S.C. 154(b) by 185 days.

(21) Appl. No.: 14/131,027

(22) PCT Filed: Jun. 25, 2012

(86) PCT No.: PCT/EP2012/062194
§ 371 (c)(1),
(2), (4) Date: Jan. 6, 2014

(87) PCT Pub. No.: WO2013/007500
PCT Pub. Date: Jan. 17, 2013

(65) Prior Publication Data

US 2014/0156285 A1 Jun. 5, 2014

(30) Foreign Application Priority Data

Jul. 8, 2011 (EP) ..... 11305883

(51) Int. Cl.
*G10L 19/00* (2013.01)
*G10L 19/018* (2013.01)
(Continued)

(52) U.S. Cl.
CPC ..... *G10L 19/018* (2013.01); *G10L 19/008* (2013.01); *G10L 19/035* (2013.01); *G10L 19/24* (2013.01); *G10L 21/038* (2013.01)

(58) Field of Classification Search
CPC ..... G10L 19/008; G10L 19/24; G10L 19/167; G10L 21/038; G11B 20/10527
(Continued)

(56) References Cited

U.S. PATENT DOCUMENTS

2003/0161469 A1 8/2003 Cheng
2004/0184369 A1* 9/2004 Herre ..... G10L 19/02 369/47.1
(Continued)

FOREIGN PATENT DOCUMENTS

AU 2002951815 10/2002
CN 101271690 9/2008
(Continued)

OTHER PUBLICATIONS

Delpha et al., "An Efficient Low Bit-Rate Information Embedding Costa Based Scheme Using a Perceptual Model", Apr. 15-20, 2007, p. 11-189.
(Continued)

*Primary Examiner* — Vu B Hang
(74) *Attorney, Agent, or Firm* — Myers Wolin LLC

(57) ABSTRACT

With quantization index modulation QIM it is possible to achieve a very high data rate, and the capacity of the watermark transmission is mostly independent of the characteristics of the original audio signal, but the audio quality suffers from degradation with each watermark embedding-and-removal step. In order to avoid degradation of the audio quality, the inventive audio signal watermarking uses specific quantizer curves in time domain and in particular in frequency domain for embedding the watermark message into the audio signal, whereby the processing is almost perfectly reversible. Furthermore, it has embedded a power constraint in order to guarantee that the modifications of the audio signal due to the watermark embedding are inaudible.

14 Claims, 2 Drawing Sheets

Figure 1:
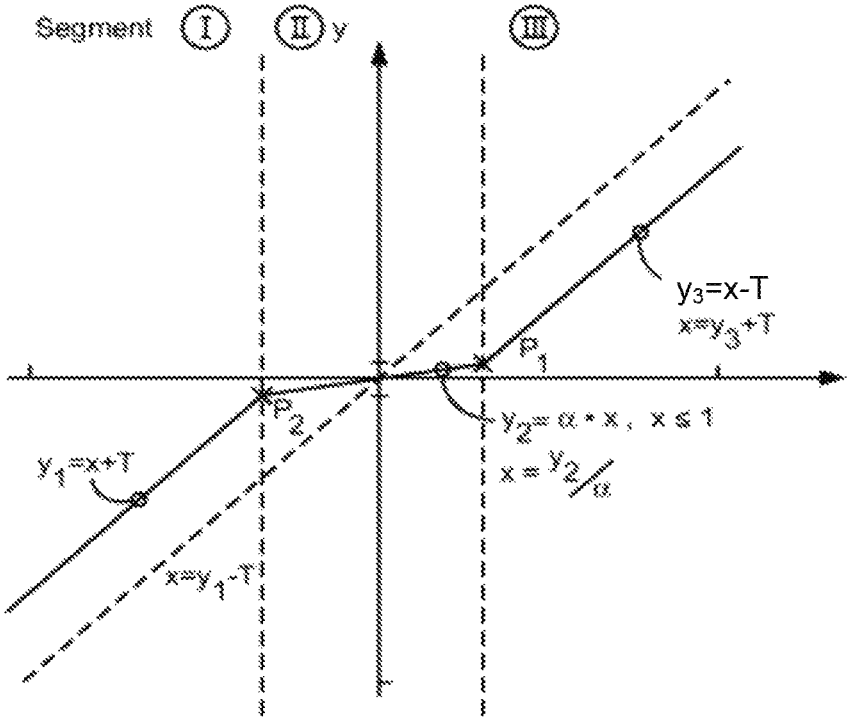

(51) Int. Cl.

| | |
|---|---|
| ***G10L 19/008*** | (2013.01) |
| *G10L 21/038* | (2013.01) |
| *G10L 19/24* | (2013.01) |
| *G10L 19/035* | (2013.01) |

(58) Field of Classification Search
USPC ..... 704/200.1, 201, 230, 256.8, 500, 501
See application file for complete search history.

(56) References Cited

U.S. PATENT DOCUMENTS

| | | | |
|---|---|---|---|
| 2005/0033579 | A1 | 2/2005 | Bocko et al. |
| 2008/0201586 | A1 | 8/2008 | Onishi et al. |
| 2008/0267412 | A1 | 10/2008 | Oostveen |

FOREIGN PATENT DOCUMENTS

| | | | |
|---|---|---|---|
| JP | 2008-502194 | A | 1/2008 |
| JP | 2008-205194 | A | 9/2008 |
| WO | WO2006052220 | | 5/2006 |
| WO | WO2006123262 | | 11/2006 |
| WO | WO2006128769 | | 12/2006 |
| WO | WO2007031423 | | 3/2007 |

OTHER PUBLICATIONS

Qiao et al., "Using Perceptual Models to Improve Fidelity and Provide Resistance Valumetric Scaling for Quantization Index Modulation Watermarking", vol. 2, No. 2, Jun. 1, 2007, pp. 127-139.

Chen et al., "Quantization index modulation: a class of provably good methods for digital watermarking and information embedding", IEEE Transaction on Information Theory, vol. 47(4), pp. 1423-1443, May 2001.

Eggers et al., "A blind watermarking scheme based on structured codebooks". Proc. of the IEEE Colloquium on Secure Images and Image Authentication, pp. 1-6, Apr. 10, 2000, London, GB.

Search Report Dated Jul. 31, 2012.

Chen et al., "Dither modulation a new approach to digital watermarking . . . ", Security & Watermarking of Multimedia Contents; 1999, vol. 3657, pp. 342-353.

Hogan et al., "New results on robustness of secure steganography", SPIE Proceedings, Feb. 2006, vol. 6072, pp. 1-12.

Hogan et al., "On the achievable rate of side informed embedding Techniques with Steganographic Constraints", Digital Watermarking, Proceedings, Feb. 2005, vol. 3710, pp. 387-402.

Liu et al., "Quantization Watermarking Schemes for MPEG-4 General Audio Coding", Advances in Multimedia Information Processing—PCM 2002 Lecture Notes in Computer Science, vol. 2532, 2002, pp. 442-450.

Yi-Wen Liu et al., "Watermarking Sinusoidal Audio Representations by Quantization Index Modulation in Multiple-Frequencies," Center for Computer Research in Music and Acoustics, Stanford University, Stanford, CA, IEEE International Conference on Acoustics, Speech, and Signal Processing, May 17-21, 2004, pp. 1-5.

* cited by examiner

METHOD AND APPARATUS FOR QUANTISATION INDEX MODULATION FOR WATERMARKING AN INPUT SIGNAL

This application claims the benefit, under 35 U.S.C. § 365 of International Application PCT/EP2012/062194, filed Jun. 25, 2012, which was published in accordance with PCT Article 21(2) on Jan. 17, 2013 in English and which claims the benefit of European patent application No. 11305883.8, filed Jul. 8, 2011.

The invention relates to a method and to an apparatus for quantisation index modulation for watermarking an input signal, wherein different quantiser curves are used for quantising said input signal.

BACKGROUND

In known digital audio signal watermarking the audio quality suffers from degradation with each watermark embedding-and-removal step.

One of the dominant approaches for watermarking of multimedia content is called quantisation index modulation denoted QIM, see e.g. B. Chen, G. W. Wornell, "Quantization Index Modulation: A Class of Provably Good Methods for Digital Watermarking and Information Embedding", IEEE Transaction on Information Theory, vol. 47(4), pp. 1423-1443, May 2001, or J. J. Eggers, J. K. Su, B. Girod, "A Blind Watermarking Scheme Based on Structured Codebooks", Proc. of the IEE Colloquium on Secure Images and Image Authentication, pp. 1-6, 10 Apr. 2000, London, GB.

With QIM it is possible to achieve a very high data rate, and the capacity of the watermark transmission is mostly independent of the characteristics of the original audio signal.

In QIM as described by B. Chen and G. W. Wornell and mentioned above, an input value x is mapped by quantisation to a discrete output value $y=Q_m(x)$, whereby for each watermark message m a different quantiser $Q_m$ is chosen. Therefore the detector can in turn try all possible quantisers and detect the watermark message by finding the quantiser with the smallest quantisation error.

J. J. Eggers et al. mentioned above have proposed an extension to QIM in order to achieve better capacity in specific watermark channels: in this α-QIM all input values x are linearly shifted towards the reference value (i.e. towards the centroid of the quantiser) with a constant factor. The watermarked output value y can be considered as being computed by $y=Q_m(x)+\alpha(x-Q_m(x))$.

INVENTION

The Chen/Wornell processing is by definition non-reversible because information is lost in the quantisation step. The Eggers/Su/Girod processing is reversible, but it is not subject to any time-variable distortion constraint.

A problem to be solved by the invention is to avoid degradation of the audio quality with each watermark embedding-and-removal step by improving the known QIM processing. This problem is solved by the quantisation method disclosed in claim 1. An apparatus that utilises this method is disclosed in claim 2. A method for corresponding regaining is disclosed in claim 8.

The inventive audio signal watermarking uses specific quantiser curves in time domain and in particular in transform domain for embedding the watermark message into the audio signal, whereby it is almost perfectly reversible and the term 'reversible' means that the watermark can be removed in order to recover the original PCM samples with high (i.e. with near-bit-exact) quality—under the preconditions that the watermarked audio signal has not undergone significant signal modification, and that the secret key is known which is required for detection of the watermark.

The inventive reversible quantisation index modulation watermarking processing has embedded a power constraint, which is important in audio watermarking in order to guarantee that the modifications of the signal due to the watermark embedding are inaudible.

Advantageously, the inventive processing provides robustness and capacity characteristics which are competitive to state-of-the-art, non-reversible watermarking schemes, and the invention allows to reverse the watermark embedding process without significant penalties in terms of data rate, robustness and computational complexity of the watermark scheme, whereby the reversal of the watermark embedding process will deliver almost exactly the original PCM audio signal.

In principle, the inventive quantisation method is suited for quantisation index modulation for watermarking an input signal x, wherein different quantiser curves $Q_m$ are used for quantising said input signal x and a current characteristic of said quantiser curve is controlled by the current content of a watermark message m, wherein in said quantising the difference between input value and output value at any position is not greater than T, and said quantising curves $Q_m$ are reversible in that for any output value y there is a unique input value x, and wherein ±T is a value defining the y shift towards y=0 of outer sections of said quantiser curves $Q_m$ and is determined by the current psycho-acoustic masking level of said input signal x, and y is the watermarked output signal, and wherein the different quantiser curves $Q_m$ are established according to the current value of m by different shifts of the complete quantiser curve in x direction.

In particular, said quantising can be carried out according to $y=Q_m(x)+\max(x-T,\min(x+T,\alpha(x-Q_m(x))))$, wherein α is a predetermined steepness of the medium section of said quantiser curves $Q_m$, ±T is a value defining the y shift towards y=0 of the other sections of said quantiser curves $Q_m$ and is determined by the current psycho-acoustic masking level of said input signal x, and y is the watermarked output signal.

In principle the inventive quantisation apparatus is suited for quantisation index modulation for watermarking an input signal x, wherein different quantiser curves $Q_m$ are used for quantising said input signal x and a current characteristic of said quantiser curve is controlled by the current content of a watermark message m, said apparatus including:

a psycho-acoustic masking level calculator;

an embedder which carries out said quantising in which the difference between input value and output value at any position is not greater than T, and wherein said quantising curves $Q_m$ are reversible in that for any output value y there is a unique input value x, wherein ±T is a value defining the y shift towards y=0 of outer sections (I, III) of said quantiser curves $Q_m$ and is determined (26) by the current psycho-acoustic masking level of said input signal x, and y is the watermarked output signal, and wherein the different quantiser curves $Q_m$ are established according to the current value of m by different shifts of the complete quantiser curve in x direction.

In particular, said quantising can be carried out according to $y=Q_m(x)+\max(x-T,\min(x-T,\alpha(x-Q_m(x))))$, wherein $\alpha$ is a predetermined steepness of the medium section of said quantiser curves $Q_m$, $\pm T$ is a value defining the y shift towards y=0 of the other sections of said quantiser curves $Q_m$ and is determined by the current psycho-acoustic masking level of said input signal x, and y is the watermarked output signal.

In principle, the inventive regaining method is suited for regaining an original input signal x which has been processed according to said inventive quantisation method, said method including the steps:

re-quantising according to $y=Q_m(x)+\max(x-T,\min(x+T,\alpha(x-Q_m(x))))$ the received watermarked signal using said quantiser curves $Q_m$ in a corresponding manner, wherein different candidate quantiser curves $Q_m$ are checked by applying different shifts of the complete quantiser curve in x direction, and wherein said re-quantisation is carried out with a bit depth that is greater than the bit depth that was applied originally;

selecting that candidate quantiser curve $Q_m$ which matches best in the frequency domain;

based on the current $Q_m$ so determined, removing the corresponding current watermark m from signal y so as to provide said regained signal x.

Advantageous additional embodiments of the invention are disclosed in the respective dependent claims.

DRAWINGS

Figure 2:
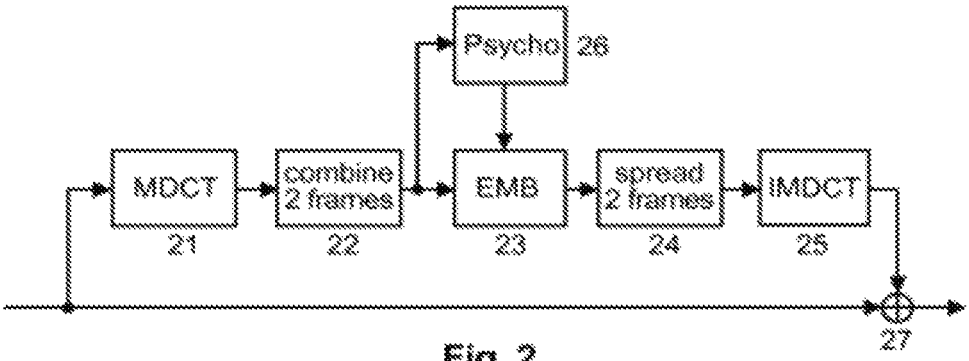
Figure 3:
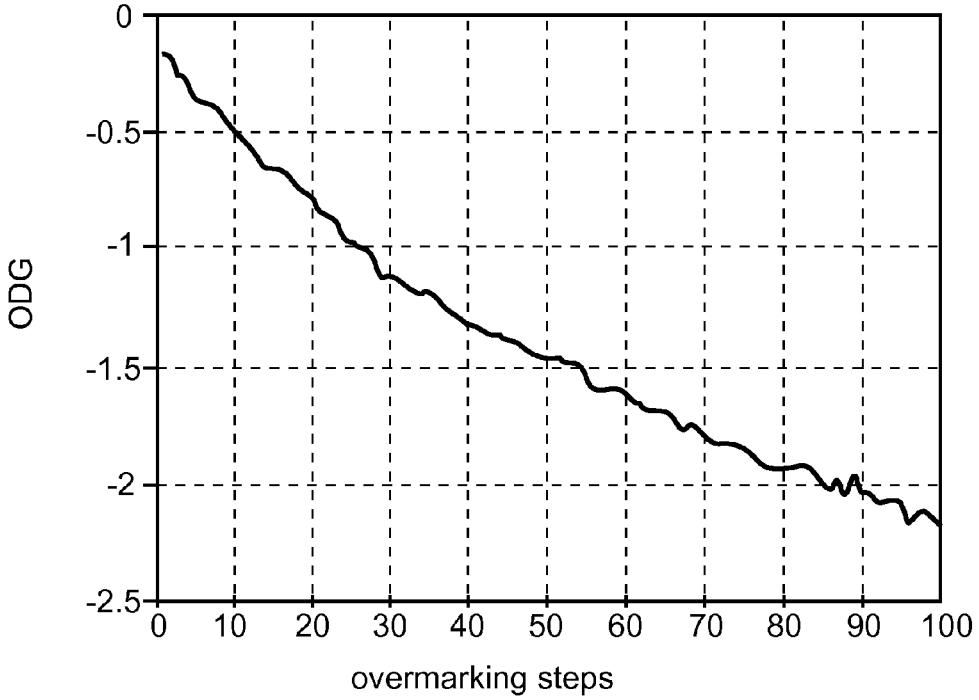
Figure 4:
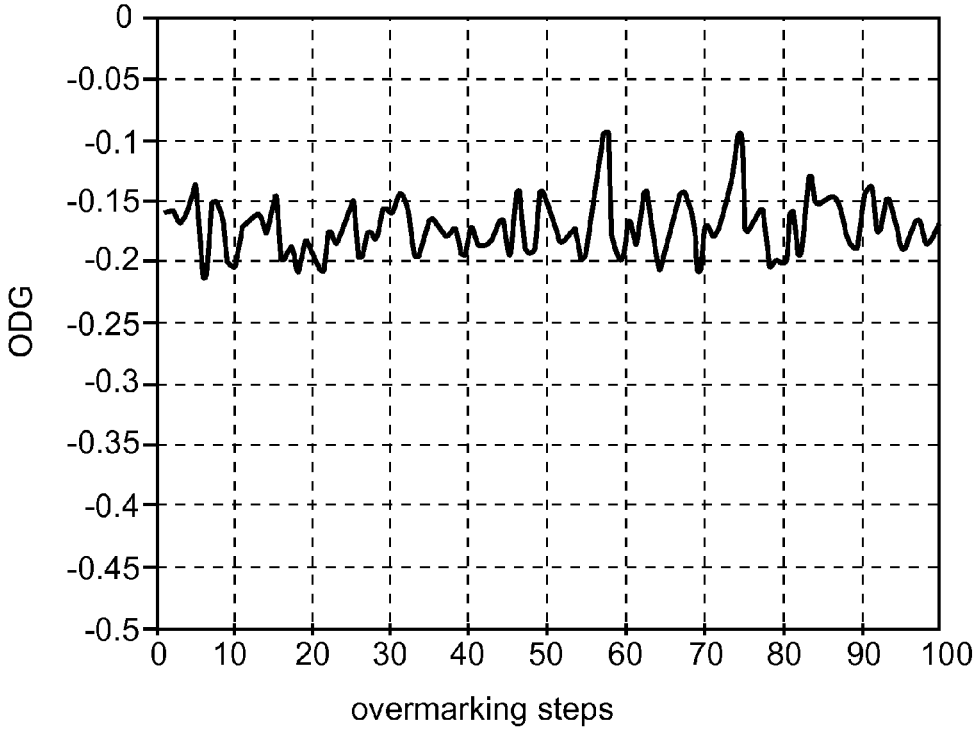

Exemplary embodiments of the invention are described with reference to the accompanying drawings, which show in:

FIG. 1 example of a reversible QIM quantiser curve for with embedding power constraint;

FIG. 2 signal flow of an embedder according to the invention;

FIG. 3 overmarking performance of known phase-based audio WM;

FIG. 4 overmarking performance according to the invention (no attack).

EXEMPLARY EMBODIMENTS

Reversible QIM watermarking with embedding power constraint The invention extends QIM in order:

to make the mapping performed at the embedder to be reversible at the decoder and to allow to take a power constraint into account when embedding a watermark.

The related characteristic curve of the quantiser has to fulfil the following two constraints:

the difference between the input and output value at any position shall not be greater than T (the embedding power constraint), the characteristic curve shall be reversible, that is for any output value y there shall be one unique input value x.

An example of a characteristic curve for one of the quantisers for the inventive reversible QIM processing with embedding power constraint is shown in FIG. 1 with output y versus input x. The curve can be divided into three linear segments I, II, III marked at the top of the figure. In segments I and III the output is shifted by the amount of T towards the reference value, i.e. towards y=zero, resulting in $y_1=x+T$ and $y_3=x-T$. The shift cannot be higher because of the power constraint. In segment II a linear curve is used with a gradient of $\alpha$, resulting in $y_2=\alpha x$ and transition points $P_1=(T/(1-\alpha), \alpha T/(1-\alpha))$ and $P_2=-P_1$. I.e., the choice of a determines the transition points $P_1$ and $P_2$ between the three segments: the greater $\alpha$, the larger will be the range which is covered by segment II.

The computation of this example characteristic curve is defined for scalar input values by $$y=Q_m(x)+\max(x-T,\min(x+T,\alpha(x-Q_m(x)))),$$

where m represents the watermark message and $Q_m$ denotes the different curves of quantisers used for embedding message m, e.g. one quantiser curve for '0' bits of m and a different quantiser curve for '1' bits.

The value of $\alpha$ is fixed in an application, and the choice of $\alpha$ is a trade-off: if $\alpha$ is near '1', the robustness of the embedded watermark is likely to be inferior than for lower values of $\alpha$, because the average shift towards the reference value is lower than possible. On the other hand, the higher the value of $\alpha$ the better is it possible to reverse the characteristic curve of the embedder in noisy conditions. The value of T is adapted to the current psycho-acoustic masking level of the input signal.

The characteristic curve in FIG. 1 has been designed to maximise the average shift of input values towards the reference value. The different quantiser curves $Q_m$ are established according to the current value of m by different shifts $s_{xm}$ of the complete quantiser curve in x direction. Other characteristic curves are possible as well, as long as they fulfil the aforementioned two constraints.

Embedding in MDCT Domain

In order to design a full or near reversible audio watermarking system, it is required to utilise filter banks with perfect reconstruction properties. Furthermore, it is highly advantageous in such application if the filter bank coefficients (e.g. MDCT frequency bins) are mutually independent: that means it is desired that any modification of one coefficient (in the embedding process) does only affect exactly the same coefficient at the decoder side (assuming perfect synchronisation of signal segments used for analysis). Any interference with other (nearby) coefficients shall be avoided. One example filter bank with these properties is the MDCT.

A corresponding example embodiment of an inventive embedder is illustrated in FIG. 2. The upper signal path is used for determining an additive watermark signal, which can be determined likewise from the watermarked signal, and includes an MDCT step or stage 21, a 2-frames combiner step/stage 22, an embedder 23 that carries out the above-described inventive quantising, in which the (current) value of T is controlled by a psycho-acoustic analyser 26 receiving its input from the output of step/stage 22, a 2-frames spread step/stage 24, an inverse MDCT step/stage 25, and a combiner that adds the output of IMDCT step/stage 25 with the input signal of MDCT step/stage 21.

Definition of a Pseudo-Complex Spectrum

The inventive quantising processing can be carried out in time domain, but preferably the signal processing takes place in frequency domain, i.e. the input signal is fed into an MDCT analysis block and the output watermark signal is produced via an inverse MDCT. Instead of MDCT/IMDCT, any other suitable time-to-frequency domain/frequency-to-time domain transforms can be used, which must allow perfect (i.e. bit-exact) reconstruction of the time domain signal. According to the invention, two consecutive MDCT frames are interpreted as real and imaginary part of one complex spectrum. Strictly mathematically, this interpretation is wrong. However, it allows to define an angular spectrum for the purpose of embedding a watermark. The actual watermark embedding corresponds to the processings described in WO 2007/031423 A1, WO 2006/128769 A2 or WO 2007/031423 A1. For inserting watermark information, only the angles (i.e. the phases) of the pseudo-complex spectrum are modified according to the constraints provided by a psycho-acoustic analysis of the input signal.

The above definition of a pseudo-complex spectrum in MDCT domain has some advantages, compared to a real angular spectrum in DFT domain as used in WO 2007/031423 A1, WO 2006/128769 A2 or WO 2007/031423 A1:

Because of the orthogonal properties of the MDCT filter bank, all MDCT coefficients are fully independent from each other, and in turn all complex coefficients of the angular spectrum interpretation are independent as well. As motivated above, this is a precondition for reversible watermarking.

Because only the angles of the pseudo-complex spectrum are modified for embedding the watermark, and because only the amplitudes are required for the psycho-acoustic analysis, the results of the psycho-acoustic analysis both for the original input signal and for the watermarked signal are perfectly identical. Again, this is required for reversibility of the embedding process.

Embedding Process

The embedding of the watermark message m is performed according to the inventive reversible QIM with embedding power constraint as described in connection with FIG. 1. The psycho-acoustic analysis of the original signal is used in order to derive maximum modifications of the angles or phases of individual coefficients of the pseudo-complex spectrum. These maximum values constitute the constraint T used in the characteristic curve from section Reversible QIM watermarking with embedding power constraint.

The input values x to the embedding curve from that section are the angles of the pseudo-complex spectrum, and the output values y are used to derive the angles of the additive watermark-only signal (in MDCT domain) y-x. The reference angles are derived from a pseudo-noise sequence according to the principles described in WO 2007/031423 A1, WO 2006/128769 A2 or WO 2007/031423 A1. The amplitudes of the complex values defined by two consecutive MDCT spectra are not modified by the watermark embedder.

The new angles (according to y-x as explained in the previous paragraph), together with the amplitudes of the complex interpretation, are again split into two real-valued, consecutive MDCT spectra. The resulting stream of MDCT spectra is fed into the inverse MDCT filter bank 25 in order to produce the additive watermark signal.

Reversibility

The watermark process is reversible because all analysis steps that are applied in order to derive the additive watermark signal are invariant to the embedding of the watermark. That means, the same additive watermark signal can be derived from the original signal as well as from the watermarked signal. There are, however, two preconditions to this property:

The watermarked signal shall not be altered significantly. Any major attack or signal modification will impact the reproducibility of the computation of the watermark signal.

The detection of the watermark message to be removed has to be without error. Any detection error will result in the reversion of the wrong watermark modifications. Together with the above condition this means that the watermark processing shall have 100% error free detection results for no or minor attacks.

In practice, the watermark embedding process typically will not be 100% reversible if the watermarked output signal of the embedder is quantised to integer values. If, for example, the watermarked signal is quantised to 16 bit integer values, the output signal of a watermark remover will suffer from the quantisation noise of this 16 bit quantiser as compared to the original PCM samples.

Overmarking Performance of a Practical System

The above example system has been built and used to determine overmarking performance figures. The term 'overmarking' means that a sequence of embedding and removal of watermarks has been applied to one original audio signal.

Typically, the quality of the signal degrades according to the number of consecutive overmarkings. FIG. 3 shows an example of the performance of the phase-based watermarking according to WO 2007/031423 A1, WO 2006/128769 A2 or WO 2007/031423 A1. The performance metric is the objective difference grade ODG (a lower ODG value indicates worse signal quality; ODG is described in the ITV Recommendation BS.1387 (PEAQ)), which estimates the subjective difference between the original audio signal and the watermarked signal after several overmarking steps. It ranges from 0=non-noticeable distortion to 3=annoying and 4=very annoying. It is clearly visible that the quality of the watermarked signal decreases considerably after a major number of overmarkings.

For comparison, FIG. 4 shows the corresponding overmarking performance for the inventive processing for the same input signal using the embodiment described in FIG. 2 (no attack, which means that the watermarked signal has not been modified). The subjective quality of the watermarked signal stays essentially constant even after 100 overmarking steps. The noise-like fluctuation of the ODG for each overmarking step is produced by the fact that for each overmarking a different embedding key (i.e. reference sequence) has been applied, which leads to different subjective qualities of the watermarked signals.

Fully Reversible (Bit-Exact) Audio Watermarking

In a special embodiment, the above principles can also be applied in order to provide a full removal of the watermark, leading with high probability to the bit-exact original input PCM samples of the embedder. For this purpose, in a system as depicted in FIG. 2 at the output of adder 27, the output signal of the embedder is quantised with different candidate quantiser curves like at embedding side but with a bit depth (e.g. 24 bit per sample) that is consistently higher than the bit depth of the original embedder-side input PCM samples (e.g. 16 bit per sample). The actual QM curve is determined in MDCT domain as described above. Based on the current $Q_m$ so determined, the corresponding current watermark message m is removed from signal y so as to provide the regained signal x. As explained above, the removal of the watermark will lead to PCM samples that suffer from the quantisation noise from the quantisation of the watermarked signal. With the processing described, this quantisation noise will only affect some LSBs of the higher bit depth output signal of the watermark remover. Therefore this output signal can in turn be quantised to the original precision of the input PCM samples (16 bit per sample in the example above). This will remove the impairment by the quantisation noise and recover the original PCM samples.

The invention can be used for applications like:

content tracking and forensics in professional workflows including audience measurement;

intelligent DRM (digital rights management) where marks and associated rights can be modified by exchanging the watermark;

reversible degradation of the content;

for video watermarking.

The inventive processing can also be used in connection with spread spectrum based watermarking techniques.

The invention claimed is:

1. An apparatus for quantisation index modulation for watermarking an input signal x, wherein different quantiser curves $Q_m$ are used for quantising said input signal x and a current characteristic of said quantiser curves is controlled by a current content of a watermark message m to be embedded into said input signal x so as to form a watermarked output signal y from which said input signal x and said watermark message m can be recovered, said apparatus comprising:

at least one input adapted to receive said input signal x and the watermark signal m, at least one processor adapted to quantise, using said quantiser curves $Q_m$, said input signal x, a current quantiser curve $Q_m$ being selected for quantizing a current content of said input signal x so that the current characteristic of said current quantiser curve $Q_m$ corresponds to the current content of said watermark signal m, and an input value of said input signal x being transformed to an output value of said output signal y according to said selected current quantiser curve $Q_m$, wherein the difference between input value and output value at any position is not greater than T, and said quantising curves $Q_m$ are reversible in that for any output value of the output signal y there is a unique input value of the input signal x, said at least one processor being further configured to define the y shift towards y=0 of outer sections of said quantiser curves $Q_m$ by a value ±T, which is determined by the current psycho-acoustic masking level of said input signal x, and y is the watermarked output signal, and to establish the different quantiser curves $Q_m$ according to the current value of m by different shifts of the complete quantiser curve in x direction, at least one output adapted to output the watermarked output signal y obtained from quantizing said input signal x with said quantiser curves $Q_m$, wherein said input signal x is an audio signal or a video signal, wherein the output signal y is configured to avoid degradation upon playback.

2. The apparatus according to claim 1, wherein said quantising is carried out according to $y=Q_m(x)+\max(x-T, \min(x+T,\alpha(x-Q_m(x))))$, wherein $\alpha$ is a predetermined steepness of the medium section of said quantiser curves $Q_m$, ±T is a value defining the y shift towards y=0 of the other sections of said quantiser curves $Q_m$ and is determined by the current psycho-acoustic masking level of said input signal x, and y is the watermarked output signal.

3. The apparatus according to claim 1, wherein said quantising is carried out in frequency domain.

4. The apparatus according to claim 3, in which said at least one processor is further configured for time-to-frequency transform and frame pair combining, wherein of every successive frame pair one frame is treated as representing a real part of one current frame and the other frame is treated as representing an imaginary part of that current frame, and for frequency-to-time transform, so as to form said watermarked output signal y.

5. The apparatus according to claim 4, wherein said time-to-frequency transform is an MDCT and said frequency-to-time transform is an IMDCT.

6. The apparatus according to claim 4, wherein said quantizing is applied to phases of individual coefficients of a complex spectrum given by said real part and said imaginary part corresponding to said every successive frame pair.

7. An apparatus for regaining an original input signal x which has been processed by quantizing, by an embedder and using different quantiser curves $Q_m$, the input signal x, a current characteristic of said quantiser curve being controlled by a current content of a watermark message m embedded in said input signal x so as to form a watermarked output signal y from which said input signal x and said watermark message m can be recovered, a current quantiser curve $Q_m$ being selected for quantizing a current content of said input signal x so that the current characteristic of said current quantiser curve $Q_m$ corresponds to the current content of said watermark signal m, and an input value of said input signal x being transformed to an output value of said output signal y according to said selected current quantiser curve $Q_m$, wherein in said quantising the difference between input value and output value at any position is not greater than T, and that said quantising curves $Q_m$ are reversible in that for any output value of the output signal y there is a unique input value of the input signal x, defining, by a psycho-acoustic masking level calculator, the y shift towards y=0 of outer sections of said quantiser curves $Q_m$ by a value ±T, which is determined by the current psycho-acoustic masking level of said input signal x, and y is the watermarked output signal, and establishing the different quantiser curves $Q_m$ according to the current value of m by different shifts of the complete quantiser curve in x direction, said apparatus comprising:

at least one input adapted to receive the output signal y, at least one processor configured for re-quantising the received watermarked signal using said quantiser curves $Q_m$ in a corresponding manner, wherein different candidate quantiser curves $Q_m$ are checked by applying different shifts of the complete quantiser curve in x direction, and wherein said re-quantisation is carried out with a bit depth that is greater than the bit depth that was applied originally;

said at least one processor being further configured to select that candidate quantiser curve $Q_m$ which matches best in the frequency domain, and based on the current $Q_m$ so determined, to remove the corresponding current watermark signal m from signal y so as to provide said regained signal x, at least one output adapted to output said regained signal x and said corresponding current watermark signal m, wherein said input signal x is an audio signal or a video signal, wherein the output signal y is configured to avoid degradation upon playback.

8. A method for quantisation index modulation for watermarking an input signal x, comprising:

receiving said input signal x and a watermark signal m at least one input, quantising, by at least one processor and using different quantiser curves $Q_m$, said input signal x, a current characteristic of said quantiser curves being controlled by a current content of the watermark message m to be embedded into said input signal x so as to form a watermarked output signal y from which said input signal x and said watermark message m can be recovered, a current quantiser curve $Q_m$ being selected for quantizing a current content of said input signal x so that the current characteristic of said current quantiser curve $Q_m$ corresponds to the current content of said watermark signal m, and an input value of said input signal x being transformed to an output value of said output signal y according to said selected current quantiser curve $Q_m$, wherein in said quantising the difference between input value and output value at any position is not greater than T, and that said quantising curves $Q_m$ are reversible in that for any output value of the watermarked output signal y there is a unique input value of the input signal x, defining, by said at least one processor, the y shift towards y=0 of outer sections of said quantiser curves $Q_m$ by a value ±T, which is determined by the current psycho-acoustic masking level of said input signal x, establishing by said at least one processor the different quantiser curves $Q_m$ according to the current value of m by different shifts of the complete quantiser curve in x direction, outputting the watermarked output signal y obtained from quantizing said input signal x with said quantiser curves $Q_m$ at at least one output, wherein said input signal x is an audio signal or video signal, wherein the output signal y is configured to avoid degradation upon playback.

9. The method according to claim 8, wherein said quantising is carried out according to $y=Q_m(x)+\max(x-T,\min(x+T,\alpha(x-Q_m(x))))$, wherein $\alpha$ is a predetermined steepness of the medium section of said quantiser curves $Q_m$, ±T is a value defining the y shift towards y=0 of the other sections of said quantiser curves $Q_m$ and is determined by the current psycho-acoustic masking level of said input signal x, and y is the watermarked output signal.

10. The method according to claim 8, wherein said quantising is carried out in frequency domain.

11. The method according to claim 10, wherein prior to said quantisation said input signal x passes through a time-to-frequency transform and a combining of every successive frame pair, of which one frame is treated as representing a real part of one current frame and the other frame is treated as representing an imaginary part of that current frame, and a frequency-to-time transform, so as to form said watermarked output signal y.

12. The method according to claim 11, wherein said time-to-frequency transform is an MDCT and said frequency-to-time transform is an IMDCT.

13. The method according to claim 10, wherein said quantizing is applied to phases of individual coefficients of a complex spectrum given by said real part and said imaginary part corresponding to said every successive frame pair.

14. A method for regaining an original input signal x which has been processed by quantizing, by an embedder and using different quantiser curves $Q_m$, the input signal x, a current characteristic of said quantiser curve being controlled by a current content of a watermark message m embedded in said input signal x so as to form a watermarked output signal y from which said input signal x and said watermark message m can be recovered, a current quantiser curve $Q_m$ being selected for quantizing a current content of said input signal x so that the current characteristic of said current quantiser curve $Q_m$ corresponds to the current content of said watermark signal m, and an input value of said input signal x being transformed to an output value of said output signal y according to said selected current quantiser curve $Q_m$, wherein in said quantising the difference between input value and output value at any position is not greater than T, and that said quantising curves $Q_m$ are reversible in that for any output value of the output signal y there is a unique input value of the input signal x, defining, by a psycho-acoustic masking level calculator, the y shift towards y=0 of outer sections of said quantiser curves $Q_m$ by a value ±T, which is determined by the current psycho-acoustic masking level of said input signal x, and y is the watermarked output signal, and establishing the different quantiser curves $Q_m$ according to the current value of m by different shifts of the complete quantiser curve in x direction, said method including:

receiving the output signal y at at least one input, re-quantising by at least one processor the received watermarked signal using said quantiser curves $Q_m$ in a corresponding manner, wherein different candidate quantiser curves $Q_m$ are checked by applying different shifts of the complete quantiser curve in x direction, and wherein said re-quantisation is carried out with a bit depth that is greater than the bit depth that was applied originally;

selecting by said at least one processor that candidate quantiser curve $Q_m$ which matches best in the frequency domain;

based on the current $Q_m$ so determined, removing by said at least one processor the corresponding current watermark signal m from signal y so as to provide said regained signal x, outputting said regained signal x and said corresponding current watermark signal m at at least one output, wherein said input signal x is an audio signal or video signal, wherein the output signal y is configured to avoid degradation upon playback.

* * * * *